US011527219B2

(12) United States Patent
Jia et al.

(10) Patent No.: US 11,527,219 B2
(45) Date of Patent: Dec. 13, 2022

(54) METHOD AND APPARATUS FOR PROCESSING BRIGHTNESS OF DISPLAY SCREEN

(71) Applicant: BEIJING XIAOMI MOBILE SOFTWARE CO., LTD., Beijing (CN)

(72) Inventors: Yongqiang Jia, Beijing (CN); Xiaowei Gu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/560,205

(22) Filed: Dec. 22, 2021

(65) Prior Publication Data

US 2022/0310035 A1 Sep. 29, 2022

(30) Foreign Application Priority Data

Mar. 29, 2021 (CN) ..... 202110334703.8

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/066* (2013.01); *G09G 2320/0646* (2013.01); *G09G 2360/141* (2013.01); *G09G 2360/144* (2013.01)

(58) Field of Classification Search
CPC .... G09G 5/10; G09G 3/20; G09G 2320/0646; G09G 2320/066; G09G 2360/141; G09G 2360/144
See application file for complete search history.

(56) References Cited

U.S. PATENT DOCUMENTS 10,186,209 B1 * 1/2019 Shah ..... G06T 11/60
10,992,845 B1 * 4/2021 Seely ..... H04N 5/2226
2002/0024529 A1 * 2/2002 Miller ..... G09G 5/10 345/690
2006/0087245 A1 * 4/2006 Ng ..... H04M 1/22 315/149
2007/0273686 A1 * 11/2007 Watanabe ..... G06T 15/506 345/419
2008/0198151 A1 * 8/2008 Lee ..... G09G 3/36 345/207
2009/0079721 A1 * 3/2009 Gettemy ..... G09G 3/3406 345/207
2010/0053051 A1 * 3/2010 Nitanda ..... G09G 3/2003 349/116
2016/0218508 A1 * 7/2016 Pignier ..... G05B 15/02
2017/0011692 A1 1/2017 Lee et al.
2017/0110065 A1 * 4/2017 Zhang ..... G09G 3/2018
(Continued)

OTHER PUBLICATIONS

Extended European Search Report in Application No. 21217574.9, dated Jun. 20, 2022,(9p).

*Primary Examiner* — Antonio Xavier
(74) *Attorney, Agent, or Firm* — Arch & Lake LLP

(57) ABSTRACT

Examples of the present disclosure provide a method and an apparatus for processing a brightness of a display screen, and an electronic device. The method includes: obtaining a subject object of an image based on image information of the image; obtaining a first contrast of the subject object and a first gray level of the image; and adjusting a brightness of a display screen displaying the image based on the first contrast and the first gray level.

19 Claims, 5 Drawing Sheets

(56) References Cited

U.S. PATENT DOCUMENTS

| | | | | |
|---|---|---|---|---|
| 2018/0005586 | A1* | 1/2018 | Park | G09G 3/2007 |
| 2019/0172403 | A1* | 6/2019 | Li | G09G 3/3406 |
| 2019/0172417 | A1* | 6/2019 | Li | G09G 5/028 |
| 2020/0105182 | A1* | 4/2020 | Koo | G09G 3/3625 |
| 2020/0184925 | A1 | 6/2020 | Huang | |
| 2020/0211480 | A1* | 7/2020 | Xiang | G02F 1/13318 |
| 2021/0398481 | A1* | 12/2021 | Haas | H01L 27/3213 |

* cited by examiner

METHOD AND APPARATUS FOR PROCESSING BRIGHTNESS OF DISPLAY SCREEN

CROSS-REFERENCE TO RELATED APPLICATION

This application claims the benefit of priority to Chinese Patent Application No. 202110334703.8, filed on Mar. 29, 2021, the disclosure of which is incorporated herein by reference in its entirety for all purposes.

TECHNICAL FIELD

Embodiments of the disclosure relate to a field of communications technologies, and particularly to a method and an apparatus for processing a brightness of a display screen, an electronic device and a storage medium.

BACKGROUND

At present, brightness adjustment of a display screen of an electronic device is mainly based on an ambient brightness and a gray level of an image. However, such a brightness adjustment of the display screen is not accurate, which does not provide a good display effect for the image. Moreover, with the development of machine learning, there are also machine-learning-based display brightness adjustment methods. However, even with the adjustment methods based on machine learning, users still need to adjust the brightness of the display screen frequently, which is impossible to achieve accurate adjustment of the brightness of the display screen.

SUMMARY

According to a first aspect of the disclosure, a method for processing a brightness of a display screen is provided. The method includes: obtaining a subject object of an image based on image information of the image; obtaining a first contrast of the subject object and a first gray level of the image; and adjusting a brightness of a display screen displaying the image based on the first contrast and the first gray level.

According to a second aspect of the disclosure, an electronic device is provided. The electronic device includes: a processor and a memory configured to store instructions executable by the processor. The processor is configured to implement the method for processing a brightness of a display screen according to the first aspect when running the executable instructions.

According to a third aspect of the disclosure, a non-transitory computer readable storage medium is provided. The storage medium is configured to store executable programs thereon, when executed by a processor, implement the method for processing a brightness of a display screen according to the first aspect.

It should be understood that, the above general descriptions and latter detailed descriptions are only illustrative and descriptive, and may not be a limitation of the disclosure.

BRIEF DESCRIPTION OF THE DRAWINGS

The drawings herein are incorporated into the specification and constitute a part of the specification, show examples in conformity with examples of the present disclosure, and explain the principle of the present disclosure together with the specification.

DETAILED DESCRIPTION

The example embodiments will be described in detail here, and examples thereof are shown in the accompanying drawings. When the following descriptions refer to the accompanying drawings, unless otherwise indicated, the same numbers in different drawings represent the same or similar elements. The implementations described in the following example embodiments do not represent all the implementations consistent with the present invention. Rather, they are merely examples of the apparatus and method consistent with some aspects of the present invention as detailed in the appended claims.

In order to facilitate understanding of those skilled in the art, examples of the disclosure list multiple implementations to clearly explain the example technical solution of the disclosure. Those skilled in the art can understand that multiple examples provided by the disclosure can be executed alone, in combination with the methods of other examples in this disclosure, or executed alone or in combination with some methods of other related technologies, which is not limited in examples of the disclosure.

Figure 1:
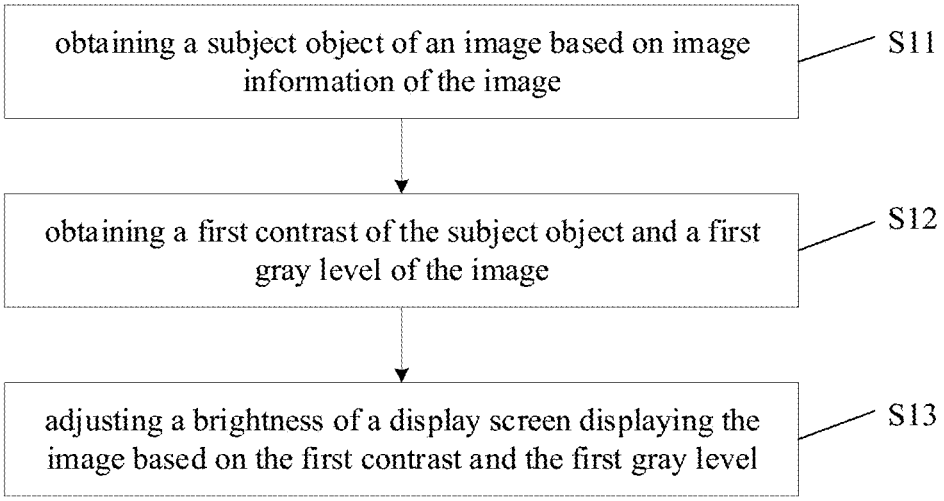
FIG. 1 is a flow chart of a method for processing a brightness of a display screen according to an example.

FIG. 1 is a flow chart of a method for processing a brightness of a display screen. As illustrated in FIG. 1, the method for processing the brightness of the display screen includes the followings.

At S11, a subject object of the image is obtained based on image information of the image.

At S12, a first contrast of the subject object and a first gray level of the image are obtained.

At S13, a brightness of a display screen displaying the image is adjusted based on the first contrast and the first gray level.

The method for processing the brightness of the display screen described in examples of the disclosure is applied to an electronic device. The electronic device here may be any mobile terminal or fixed terminal. For example, the electronic device may be but is not limited to a computer, a mobile phone, a server, a tablet, a wearable device, a vehicle-mounted electronic device, a smart home electronic device and/or a medical device, etc.

In an example, the image information of the image may include information of each pixel in the image. For example, the image information may include color information of red (R), green (G) and blue (B) channels of each pixel.

In another example, the image information of the image may also include information in the image describing people, animals, plants, landscapes and/or text, etc. In other examples, the image information of the image may be any information describing contents of the image.

Here the subject object may refer to main information in the image. For example, the image contains main information and background information, then the subject information is the main information.

The subject object here may also be the main information to be captured when the image is taken. For example, if the user wants to take a portrait photo of a character, the character is the subject object, and the scenery behind the character is not the subject object. For example, if the user wants to take a picture of a person and a dog, the person and the dog are the subject objects, and other content is not the subject object.

The subject object here may also be information in the image in addition to background information. For example, the image is a portrait photo of a character, then the character is the subject object, and the background of the character is not the subject object. For another example, the image is a picture of a flower in full bloom, then the flower is the subject object, and the background that sets off the flower is not the subject object. For yet another example, the image is a picture of a dog running, the dog, the ball which the dog is chasing and grass in the image may be the subject objects, while other background information is not the subject object.

In an example, the subject objects include but are not limited to at least one of the following: people, animals, plants, food, buildings, landscapes and text. For example, a plant may be a flower, tree or grass. For another example, the landscape may be mountains, rivers or waterfalls. For another example, food may be vegetables, fruits and so on. In other examples, the subject object may also be a variety of objects, for example, may be clothing items such as clothes, shoes or hats, or electronic devices such as mobile phones, tablets or wearable watches, or teacups, stationery or books.

Figure 2:
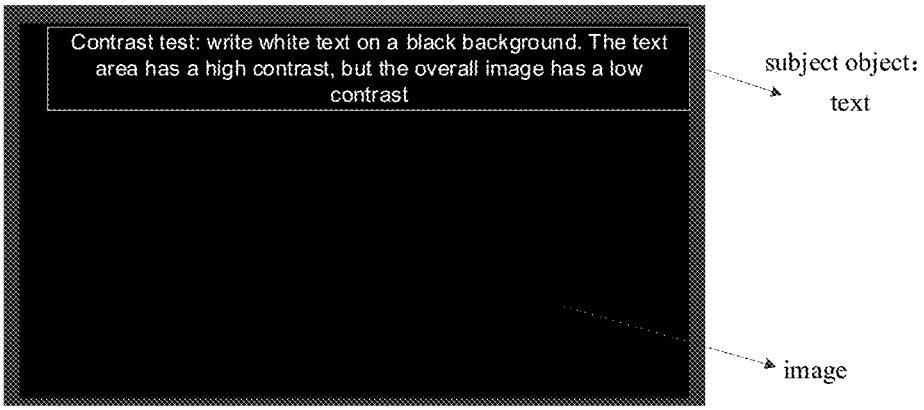
FIG. 2 is a schematic diagram illustrating a subject object as text according to an example.
Figure 3:
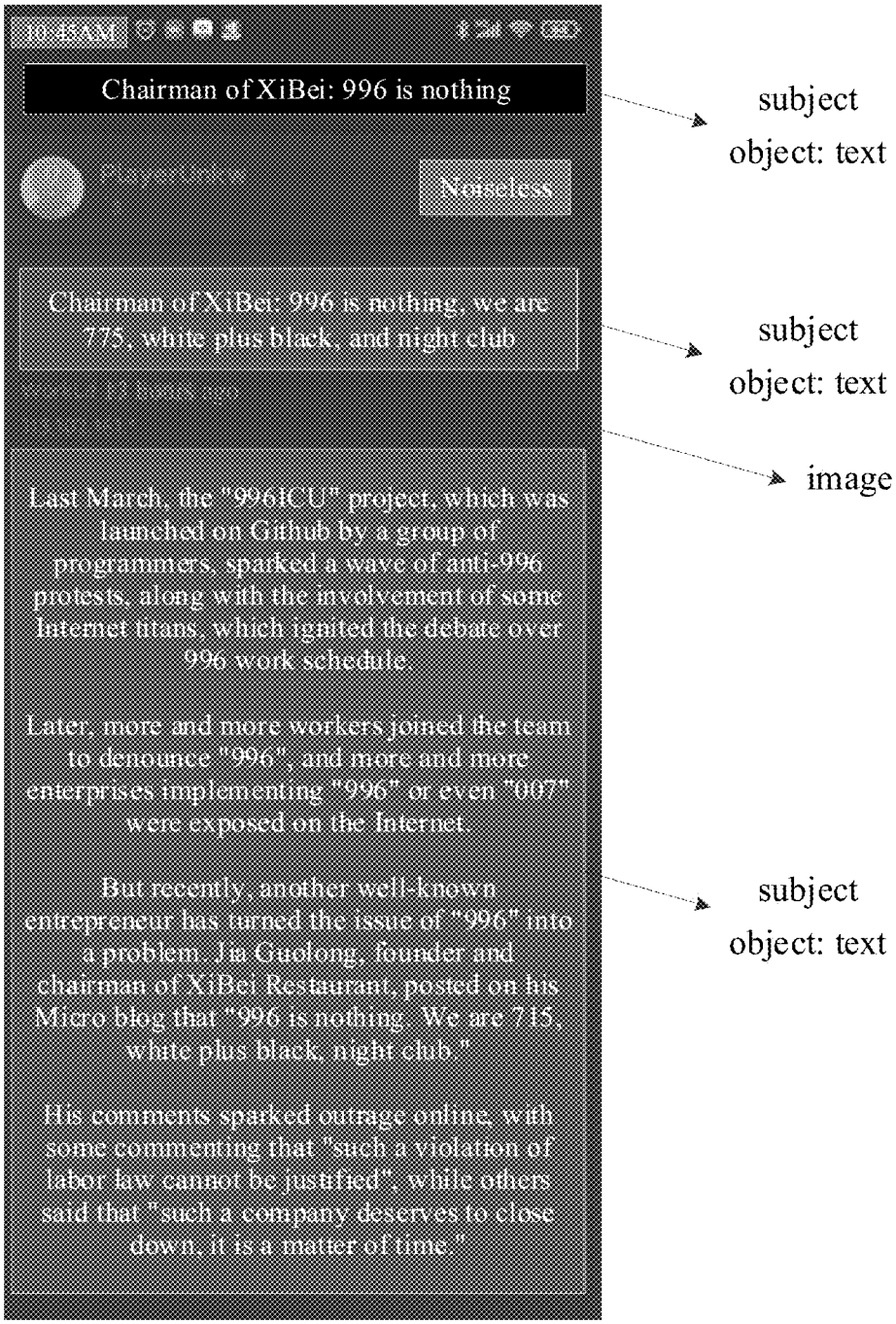
FIG. 3 is a schematic diagram illustrating subject objects as text according to an example.
Figure 4:
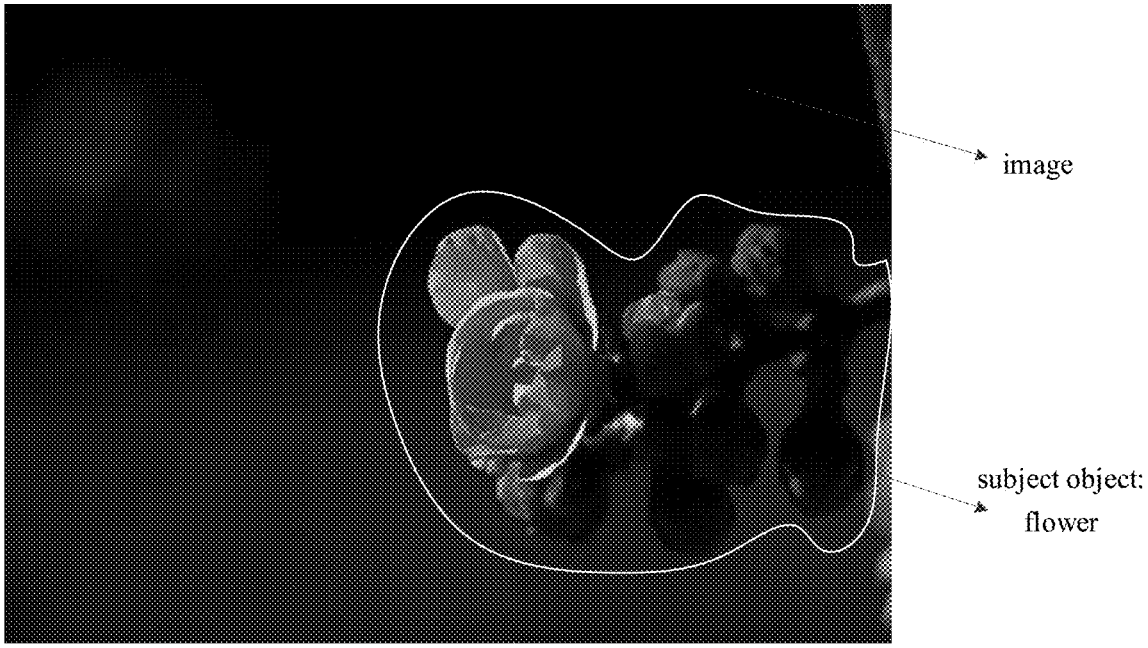
FIG. 4 is a schematic diagram illustrating a subject object as a flower according to an example.

For example, as illustrated in FIGS. 2 and 3, the subject object of the image is text; as illustrated in FIG. 4, the subject object of the image is the flower.

In an example, there is one subject object of the image. For example, as shown in FIG. 2 and FIG. 4, the image has one subject object.

In another example, the image has at least two subject objects. For example, as shown in FIG. 3, the image has multiple body objects. If the image has at least two subject objects, the at least two subject objects may be of the same type, or may be different types of subject objects. For example, when there are two subject objects in the image, both of them may be characters or flowers, or one subject object is a character and another is a flower.

In an example, S11 includes:

determining the subject object of the image based on a deep learning model and the image information.

The deep learning model here may be any kind of deep learning model, such as deep learning MobileNet model, which is not limited here.

The deep learning model here may be the deep learning model used to identify people, or the deep learning model used to identify animals, etc. For example, in an example, the subject objects include at least one of the following: people, animals, flowers, and text. The deep learning model includes at least one of the following: the deep learning model for recognizing people, the deep learning model for recognizing animals, the deep learning model for recognizing flowers and the deep learning model for recognizing text.

For example, the deep learning model is used to identify flowers. A predetermined number of flower image samples were trained to obtain the deep learning model. The image or the image information of the image is input into the deep learning model and the subject object of the image is obtained.

Thus, in examples of the disclosure, the subject object of the image can be obtained based on the detection method of deep learning. On one hand, the intelligence of electronic devices can be improved, and on the other hand, the subject object can be extracted from massive images to simplify user operations.

In other examples, in S11, the subject object of the image may be obtained based on the image information in other ways, which is not limited here.

In an example, obtaining the first contrast of the subject object in S12 may include:

obtaining each pixel of the subject object; and determining the contrast of the subject object based on gray differences of adjacent pixels and a pixel distribution probability of the gray differences of adjacent pixels.

For example, the first contrast of the subject object may be calculated according to the following formula:

$$C = \sum_{\delta} \delta(i, j)^2 P_{\delta}(i, j)$$

where, C is the first contrast; $\delta(i,j)$ is the gray difference of adjacent pixels, in which i and j are adjacent pixels in the subject object, and $\delta(i,j)=|i-j|$; $P_{\delta}(i,j)$ is the distribution probability of pixels in the subject object with gray difference of adjacent pixels is $\delta$. Thus, in examples of the disclosure, the first contrast of the subject object can be accurately determined by the gray differences between adjacent pixels and their corresponding pixel distribution probability.

In other examples, obtaining the first contrast of the subject object in S12 may be achieved in any other way. For example, the first contrast of the subject object may be determined according to a ratio of a maximum brightness to a minimum brightness of respective pixels in the subject object. The way in which the first contrast of the subject object is obtained is not limited in examples of the disclosure.

In an example, obtaining the first gray level of the image in S12 may include:

obtaining the gray level of each pixel in the image; and obtaining the first gray level of the image based on the gray level of each pixel in the image.

For example, the RGB value of each pixel in the image may be obtained, and the gray level of each pixel may be calculated according to the following formula:

$$Gray=R\times a1+G\times a2+B\times a3$$

where, Gray is the gray level of the pixel; R, G and B are red, yellow and blue color channels respectively; a1, a2 and a3 are coefficients of red, yellow and blue channels respectively. In an example, a1, a2 and a3 may be 0.3, 0.59 and 0.11, respectively. Thus, in examples of the disclosure, the first gray level of the whole image can be obtained by combining the gray level of each pixel after obtaining the gray level of each pixel.

In other examples, obtaining the first gray level of the image in S12 may be achieved in any other way, which is not limited here.

In an example, the brightness of the display screen is the backlight brightness of the display screen.

In examples of the disclosure, the subject object of the image can be obtained based on the image information, the first contrast of the subject object and the first gray level of the image can be obtained, and the brightness of the display screen displaying the image can be adjusted based on the first contrast and the first gray level. Thus, in examples of the disclosure, the brightness of the display screen can be automatically adjusted against the subject object of the image, which can make the display of the subject object of the image more meet the expected brightness of the user. Thus, more accurate brightness adjustment of the display screen can be obtained to meet the needs of users, and user satisfaction can be improved.

In addition, examples of the disclosure can also make display of the whole image more satisfied with the user's expected display effect.

In some examples, S13 includes: adjusting the brightness of the display screen to increase correspondingly as the first contrast decreases and/or the first gray level increases; or, adjusting the brightness of the display screen to decrease correspondingly as the first contrast increases and/or the first gray level decreases.

It can be understood that, if the first gray level is higher, the image is blacker; if the first gray level is lower, the image is whiter. If the first contrast is greater, the image is clearer and brighter; if the first contrast is smaller, the image is less clear and darker.

Thus, in examples of the disclosure, the brightness of the display screen is reduced when the first contrast of the subject object in the image is relatively large, and/or when the first gray level of the image is relatively high. Alternatively, the brightness of the display screen is increased when the first contrast of the subject object in the image is relatively low, and/or when the first gray level of the image is relatively low. In this way, in examples of the disclosure, the brightness of the display screen can be automatically adjusted based on the first contrast and the first gray level, so as to meet the user's demand for the appropriate display brightness of the subject object.

In other examples, S13 includes:

adjusting the brightness of the display screen displaying the image based on the ambient brightness, the first contrast and the first gray level.

Figure 5:
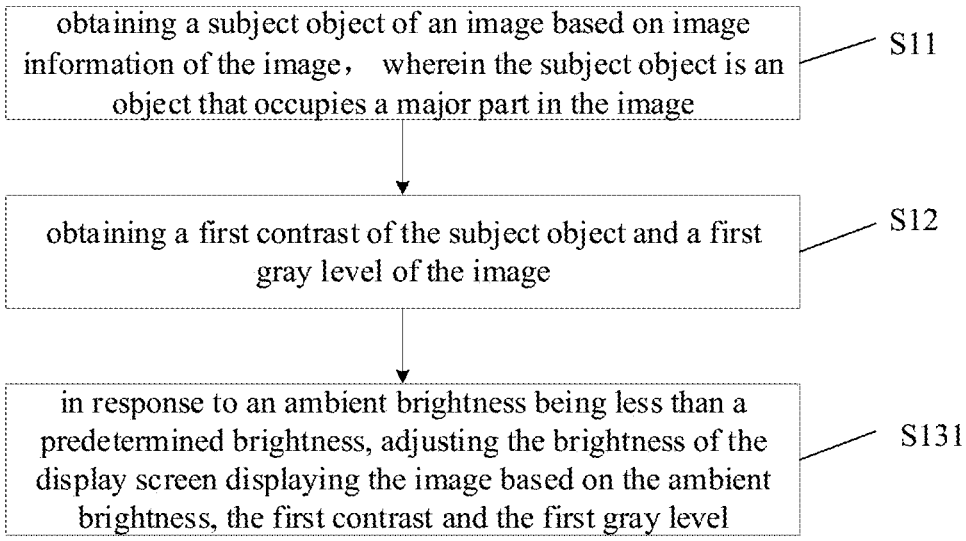
FIG. 5 is a flow chart of a method for processing a brightness of a display screen according to an example.

As illustrated in FIG. 5, in an example, S13 includes:

S131, in response to the ambient brightness being less than a predetermined brightness, adjusting the brightness of the display screen displaying the image based on the ambient brightness, the first contrast and the first gray level.

In an example, if the ambient brightness is less than the predetermined brightness, the display screen may be considered to be in an indoor environment or an environment without sunlight exposure; if the ambient light is greater than or equal to the predetermined brightness, the display screen may be considered to be in an outdoor environment or a sunny environment.

In examples of the disclosure, the influence of ambient brightness on image display can be considered. For example, when the ambient brightness is less than the predetermined brightness, the brightness of the display screen is determined based on the ambient brightness, the first contrast of the subject object of the image and the first gray level of the whole image. In this way, the user experience can be further improved by obtaining the desired and comfortable display brightness of the subject object.

In other examples, if the ambient brightness is greater than the predetermined brightness, the brightness of the display screen can be directly increased to a first predetermined brightness. The first predetermined brightness here may be the maximum brightness of the display screen, or a brightness that differs from the maximum brightness by a predetermined value. In this way, when the ambient brightness is relatively large, such as the mobile phone under the sun, the first gray level of the image and the first contrast of the subject object of the image have little influence on the image display. In this case, the brightness of the display screen to the maximum brightness can be increased to make the image on the display screen brighter, so that the user can see the image on the display screen.

Figure 6:
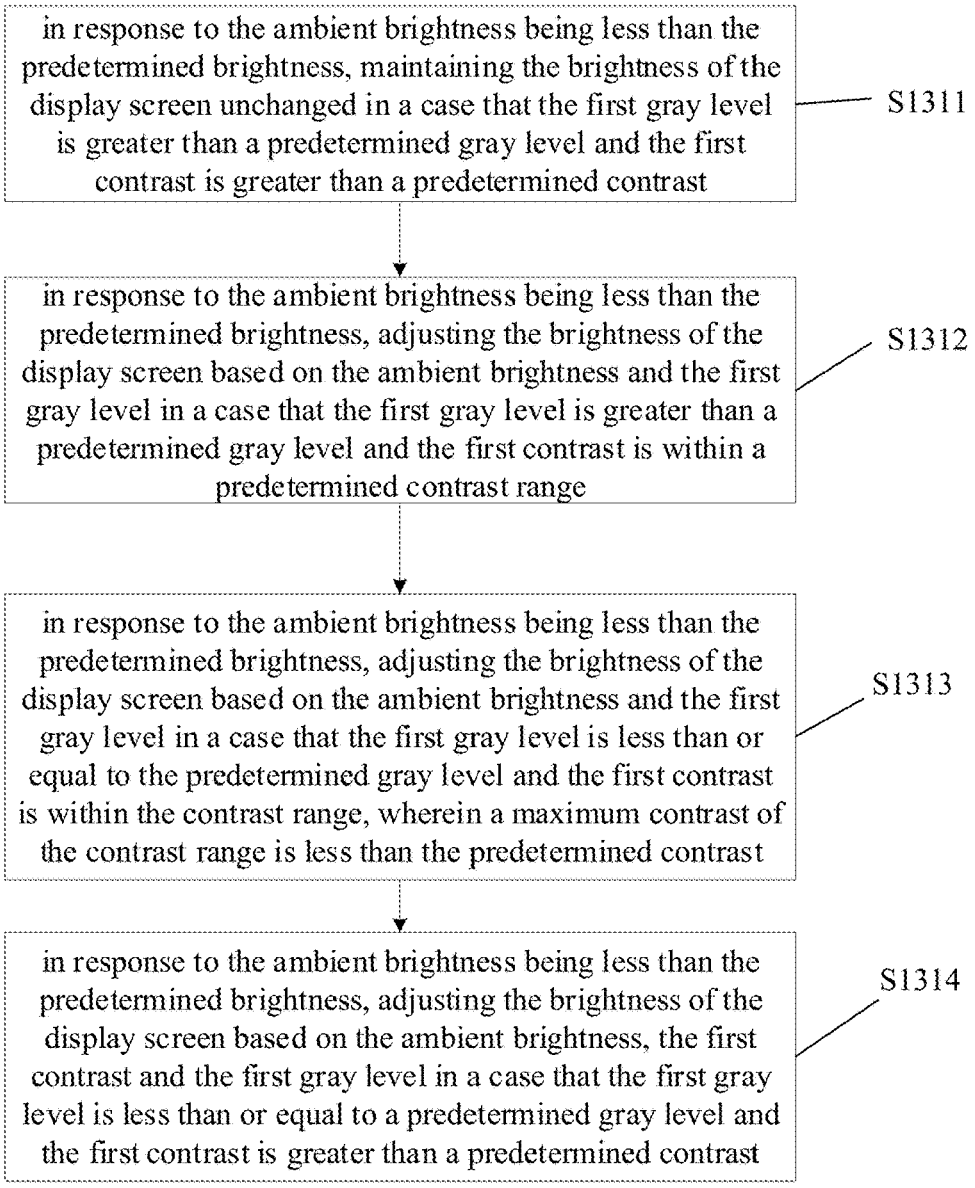
FIG. 6 is a flow chart of a method for processing a brightness of a display screen according to an example.

As illustrated in FIG. 6, in some examples, S131 includes:

S1311, in response to the ambient brightness being less than the predetermined brightness, maintaining the brightness of the display screen unchanged in a case that the first gray level is greater than a predetermined gray level and the first contrast is greater than a predetermined contrast.

In an example, if the first gray level of the image is greater than the predetermined gray level, the image is determined to be relatively black; if the first gray level of the image is less than or equal to the predetermined gray level, the image is determined to be relatively white. For example, the gray value of gray level may be expressed as 0 to 255, and the predetermined gray level may be a value less than 127 or less than 100, etc. For another example, the gray level may be expressed by 0% to 100%, and the predetermined gray level may refer to a value greater than 50% or greater than 60% or 70%, etc.

In an example, if the first contrast of the subject object is greater than the predetermined contrast, the subject object is determined to be relatively bright; if the first contrast of the body object is less than or equal to the predetermined contrast, the body object is determined to be relatively dark. For example, the contrast range of an image is represented as 0% to 100%, and the predetermined contrast may be a value greater than 50% or 60% or 70%, etc.

For example, as shown in FIG. 2, the first gray level of the image is greater than the predetermined gray level, that is, the image is black. The contrast of the whole image is less than the predetermined contrast, that is, the image is dark. However, the first contrast of the subject object of the image, namely the text area, is greater than the predetermined contrast, that is, the text area in the image has been relatively bright. At this time, there is no need to increase the brightness of the display screen displaying the image, that is, the brightness of the display screen can be maintained unchanged.

In the above example, if the contrast of the whole image in FIG. 2 is greater than the predetermined contrast, the brightness of the display screen can also be maintained unchanged.

For example, as shown in FIG. 4, the first gray level of the image is greater than the predetermined gray level, that is, the image is black. The contrast of the whole image is less than the predetermined contrast, that is, the image is dark. However, the first contrast of the subject object of the image, namely the flower, is greater than the predetermined contrast, that is, the flower in the image is already relatively bright. At this time, there is no need to increase the brightness of the display screen displaying the image, that is, the brightness of the display screen can be maintained unchanged.

In the above example, if the contrast of the whole image in FIG. 4 is greater than the predetermined contrast, the brightness of the display screen can also be maintained unchanged.

In examples of the disclosure, if the ambient brightness is less than the predetermined brightness, that is, the display screen of electronic device is indoors or in an environment without sunlight exposure, the image is relatively black and the subject object of the image is relatively bright, that is, the subject object is already relatively bright, and there is no need to increase the brightness of the display screen of the electronic device. And if the contrast of the whole image is relatively dark, but the subject object is relatively bright, there is still no need to improve the brightness of the display screen of electronic device, and the brightness of the display screen can be maintained unchanged.

Referring to FIG. 6 again, in some examples, S131 includes:

S1312, in response to the ambient brightness being less than the predetermined brightness, adjusting the brightness of the display screen based on the ambient brightness and the first gray level in a case that the first gray level is greater than the predetermined gray level and the first contrast is within a predetermined contrast range;

or,

S1313, in response to the ambient brightness being less than the predetermined brightness, adjusting the brightness of the display screen based on the ambient brightness and the first gray level in a case that the first gray level is less than or equal to the predetermined gray level and the first contrast is within the contrast range, wherein the maximum contrast of the contrast range is less than the predetermined contrast.

In an example, if the first contrast of the subject object is within the predetermined contrast range, the subject object may be considered to be of relatively moderate brightness. For example, if the contrast range of the image is 0% to 100%, the predetermined contrast range may be (50%, 60%).

In an example, the contrast range may be pre-set based on user input operations or may be pre-set based on historical empirical data.

In an example, if the first contrast of the subject object is greater than the maximum contrast of the contrast range, the subject object is relatively bright; if the first contrast of the subject object is less than the minimum contrast of the contrast range, the subject object is relatively dark.

In some examples, adjusting the brightness of the display screen based on the ambient brightness and the first gray level, includes:

determining that the brightness of the display screen is positively correlated with the ambient brightness and positively correlated with the first gray level.

For example, adjusting the brightness of the display screen based on the ambient brightness and the first gray level, includes:

increasing the brightness of the display screen increases correspondingly with the increase of the ambient brightness and/or the increase of the first gray level; or, decreasing the brightness of the display screen correspondingly with the decrease of the ambient brightness and/or the decrease of the first gray level.

For example, if the first gray level of the image is greater than the predetermined gray level, the image is black; if the first contrast of the subject object of the image is in the contrast range, the display brightness of the subject object is relatively moderate. In this case, the brightness of the display screen can be adjusted according to the ambient brightness and the first gray level. For example, if the ambient brightness is less than the predetermined brightness and greater than the first brightness value, and the first gray level is greater than the predetermined gray level, then the brightness of the display screen can be increased accordingly, wherein, the first brightness value is greater than the predetermined brightness. For another example, if the ambient brightness is greater than the predetermined brightness and less than the first brightness value, and the first gray is less than the predetermined gray, the brightness of the display screen can be reduced accordingly.

In examples of the disclosure, if the ambient brightness is less than the predetermined brightness, i.e., the display screen of the electronic device is in the indoor environment or the environment without sunlight exposure, and the first contrast of the subject object is in the contrast range, namely, the contrast of the subject object is moderate (such as normal contrast, not too high or too dark), then the first contrast of the subject object can be ignored. In this scenario, the brightness of the display screen can be adjusted directly based on the ambient brightness and the first gray level of the image, and the display screen can also meet the user's expectation of the appropriate display brightness when the subject object is displayed based on the brightness adjustment. Moreover, in examples of the disclosure, when the first contrast of the subject object is relatively moderate, the brightness of the display screen can be adjusted without considering the first contrast of the subject object, thus simplifying the brightness adjustment of the display screen.

Referring to FIG. 6 again, in some examples, S131 includes:

S1314, in response to the ambient brightness being less than the predetermined brightness, adjusting the brightness of the display screen based on the ambient light brightness, the first gray level and the first contrast in a case that the first gray level is less than or equal to the predetermined gray level and the first contrast is greater than the predetermined contrast.

In some examples, adjusting the brightness of the display screen based on the ambient brightness, the first gray level and the first contrast, includes:

determining that the brightness of the display screen is positively correlated with the ambient brightness, positively correlated with the first gray level and inversely correlated with the first contrast.

For example, adjusting the brightness of the display screen based on the ambient brightness, the first gray level and the first contrast, includes:

increasing the brightness of the display screen correspondingly with the increase of the ambient brightness, the increase of the first gray level and/or the decrease of the first contrast;

or, decreasing the brightness of the display screen correspondingly with a decrease of the ambient brightness, a decrease of the first gray level and/or an increase of the first contrast.

For example, if the first gray level of the image is less than the predetermined gray level, that is, the image is white, and the first contrast of the subject object is greater than the predetermined contrast, that is, the subject object is already relatively bright, then in this case, the subject object is relatively bright and the whole image is white, and thus the brightness of the display screen can be adjusted according to the first contrast of the subject object, the first gray level of the image and the ambient brightness.

In the scene of the above example, the subject object is relatively bright and the whole image is white, so the brightness of the display screen can be adjusted by reducing the brightness of the display screen. For example, in the case of a certain ambient brightness, if the first gray level of the image is less than the predetermined gray level and less than the first gray value, and the first contrast of the subject object is greater than the predetermined contrast and greater than the first contrast value, then the brightness of the display screen is reduced to the second brightness value. If the first gray level of the image is less than the predetermined gray level and greater than or equal to the first gray level value, and the first contrast of the subject object is greater than the predetermined contrast and less than the first contrast value, then the brightness of the display screen is reduced to the third brightness value. The first gray value is less than the predetermined gray value, the first contrast value is greater than the predetermined contrast, and the second brightness value is greater than the third brightness value. In this way, the reduced brightness of the display screen can be adapted to the first gray level of the image and the first contrast of the subject object, that is, the greater the increase of the first contrast and the smaller the decrease of the first gray level, the more the brightness of the display screen is reduced.

In examples of the disclosure, if the ambient brightness is less than the predetermined brightness, that is, the display screen of the electronic device is indoors or in the environment without sunlight exposure, and the first gray level is less than or equal to the predetermined gray, namely the image is white, and the first contrast of the subject object is greater than the predetermined contrast, namely the subject object of the image is brighter, then the first contrast of the subject object cannot be ignored. In this scenario, the brightness of the display screen can be reduced based on the first contrast of the subject object, the ambient brightness and the first gray level of the image, so that the display screen based on the brightness adjustment can display the subject object with the appropriate display brightness as expected by the customer. The brightness of the display screen can be further increased by taking into account the first contrast of the brighter subj ect object.

In an example, S131 includes one of followings:

in response to the ambient brightness being less than the predetermined brightness, adjusting the brightness of the display screen according to a first adjustment mode in a case that the first gray level is greater than the predetermined gray level and the first contrast is in the predetermined contrast range;

in response to the ambient brightness being less than the predetermined brightness, adjusting the brightness of the display screen according to the first adjustment mode, and based on the ambient brightness and the first gray level in a case that the first gray level is less than or equal to the predetermined gray level and the first contrast is within the contrast range;

in response to the ambient brightness being less than the predetermined brightness, adjusting the brightness of the display screen according to the first adjustment mode in a case that the first gray level is less than or equal to the predetermined gray level and the first contrast is greater than the predetermined contrast.

The maximum contrast of the contrast range is less than the predetermined contrast.

The first adjustment mode is an adjustment mode that does not consider the first contrast of the subject object, and the second adjustment mode is an adjustment mode that considers the first contrast of the subject object.

In an example, the first adjustment mode includes: increasing the brightness of the display screen, or decreasing the brightness of the display screen; the second adjustment mode includes decreasing the brightness of the display screen.

In examples of the disclosure, if the first contrast of the subject object is in the normal contrast range, that is, the subject object is neither bright nor dark, the brightness of the display screen can be adjusted regardless of the first contrast of the subject object, and the brightness of the display screen can be increased or decreased based on the first gray level and ambient brightness. Or, if the first contrast of the subject object is relatively bright, the brightness of the display screen needs to be adjusted by considering the first contrast of the subject object, and the brightness of the display screen can be adjusted based on the first contrast, the first gray level and the ambient brightness. In this way, examples of the disclosure can make sure that when the display screen is under different conditions, the brightness of the display screen is adjusted based on different adjustment methods, so that the subject object displayed on the display screen after the brightness adjustment can meet the appropriate display brightness expected by users, so as to improve user satisfaction.

In an example, the brightness of the display screen can be adjusted in any way in Table 1 below. For example, way 1: when the ambient brightness is relatively low, the first gray level of the image is relatively high, and the first contrast of the subject object is relatively high, maintain the brightness of the display screen unchanged; way 2: when the ambient brightness is relatively low, the first gray level of the image is relatively high, and the first contrast of the subject object is relatively moderate, increase or decrease the brightness of the display screen based on the ambient brightness and the first gray level; way 3: when the ambient brightness is low, the first gray level of the image is low and the first contrast of the subject object is high, decrease the brightness of the display screen based on the first contrast, the ambient brightness and the first gray level; way 4: when the ambient brightness is relatively low, the first gray level of the image is relatively low, and the first contrast of the subject object is relatively moderate, increase or decrease the brightness of the display screen based on the ambient brightness and the first gray level.

| ambient brightness | first gray level of the image | first contrast of the subject object | brightness of the display screen |
|---|---|---|---|
| low | high | high | maintain unchanged |
| low | high | moderate | increase or decrease |
| low | low | high | decrease |
| low | low | moderate | increase or decrease |

In some examples, obtaining the first contrast of the subject object includes:

if the image includes at least two subject objects, obtaining the first contrast of the subject objects of the image based on the contrast of each subject object and the weight coefficient corresponding to each subject object.

In an example, obtaining the first contrast of the subject objects of the image based on the contrast of each subject object and the weight coefficient corresponding to each subject object, includes:

obtaining a first value based on a product of the contrast of the subject object and the corresponding weight coefficient of the subject object;

obtaining the first contrast of the subject objects of the image based on the sum of the first values of respective subject objects.

For example, if the subject objects of the image include different types of subject objects, the corresponding weight coefficient can be determined according to the importance degree of different types of subject objects. The importance degree is positively correlated with the weight coefficient. For example, the subject objects include: a character, a dog, and a flower. The weight coefficient of the character is the first weight coefficient (Q1), the weight coefficient of the dog is the second weight coefficient (Q2), and the weight coefficient of the flower is the third weight coefficient (Q3). Q1 is greater than Q2, and Q2 is greater than Q3. For example, Q1 is 0.5, Q2 is 0.3, and Q3 is 0.2.

In the above examples, if the first contrast of the person is the first sub contrast (C1), the first contrast of the dog is the second sub contrast (C2), and the first contrast of the flower is the third sub contrast (C3), the first contrast (C) of the subject objects of the image may be: $C=C1\times Q1+C2\times Q2+C3\times Q3$.

Thus, in this example, different weight coefficients may be configured for different types of subject objects according to the importance of different types of subject objects, for example, the importance of human is greater than that of animals, and the importance of animals is greater than that of flowers. Thus, when there are multiple subject objects in the image, the more important subject object may be considered to have a larger portion in the contrast, thereby obtaining a more appropriate first contrast for adjusting the brightness of the display screen.

For example, if there are multiple subject objects of the image, the corresponding weight coefficient may be determined according to the area of the subject object in the image. The area of the subject object in the image is positively correlated with the weight coefficient. For example, the subject objects include: the first person and the second person. The area of the first person in the image is the first area (S1), and the area of the second person in the image is the second area (S2), so the weight coefficient of the first person can be determined to be the fourth weight coefficient (Q4), and the weight coefficient of the second person can be determined to be the fifth weight coefficient (Q5), in which Si is greater than S2, and Q4 is greater than Q5.

Thus, in this example, if there are multiple subject objects in the image, the corresponding weight coefficients of multiple subject objects can be determined based on the area sizes of multiple subject objects. For the subject object with a larger area, a larger proportion in the contrast is considered, so as to obtain a more appropriate first contrast for adjusting the brightness of the display screen.

For example, if the image has multiple subject objects, the corresponding weight coefficient can be determined according to the position of the subject object in the image. The importance of the position of the subject object in the image is positively correlated with the weight coefficient. For example, the subject objects include a first subject object and a second subject object. The first subject object is in the middle of the image, and the second subject object is at the edge of the image, then it can be determined that the weight coefficient of the first subject object is greater than that of the second subject object.

Thus, in this example, if there are multiple subject objects in the image, the weight coefficients of multiple subject objects can be determined according to the positions of multiple subject objects in the image. For the subject object that is more important in its position (such as the subject object in the middle of the image), a greater proportion in the contrast is considered, making it more appropriate to use the first contrast to adjust the brightness of the display screen.

In other examples, if there are multiple subject objects in the image, the corresponding weight coefficients of multiple subject objects can be determined based on one or more of followings: the different types of multiple subject objects, the areas of multiple subject objects in the image and the positions of the multiple subject objects in the image.

In examples of the disclosure, if there are multiple subject objects in the image, the weight coefficient of each subject object in the multiple subject objects can be determined based on the importance degree of the type of the subject object, the size of the area in the image and/or the importance degree of the position in the image. In this way, more accurate first contrast of the subject object of the image can be obtained, and thus, when the brightness of the display screen is adjusted based on the first contrast, the image (subject object) displayed based on the adjusted brightness is a more appropriate display brightness expected by the user.

Figure 7:
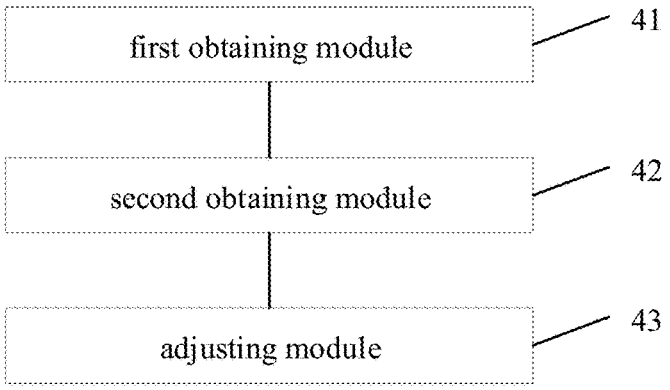
FIG. 7 is a block diagram of an apparatus for processing a brightness of a display screen according to an example.

FIG. 7 provides an apparatus for processing a brightness of a display screen according to an example. The apparatus includes a first obtaining module 41, a second obtaining module 42 and an adjusting module 43.

The first obtaining module 41 is configured to obtain a subject object of an image based on image information of the image;

The second obtaining module 42 is configured to obtain a first contrast of the subject object and a first gray level of the image.

The adjusting module 43 is configured to adjust a brightness of a display screen displaying the image based on the first contrast and the first gray level.

In some examples, the subject objects include but are limited to at least one of the following: people, animals, plants, food, buildings and text.

In some examples, the adjusting module 43 is configured to, in response to an ambient brightness being less than a predetermined brightness, adjust the brightness of the display screen displaying the image based on the ambient brightness, the first contrast and the first gray level.

In some examples, the adjusting module 43 is configured to, in response to the ambient brightness being less than the predetermined brightness, maintain the brightness of the display screen unchanged in a case that the first gray level is greater than a predetermined gray level and the first contrast is greater than a predetermined contrast.

In some examples, the adjusting module 43 is configured to, in response to the ambient brightness being less than the predetermined brightness, adjust the brightness of the display screen based on the ambient brightness and the first gray level in a case that the first gray level is greater than a predetermined gray level and the first contrast is within a predetermined contrast range;

or the adjusting module 43 is configured to, in response to the ambient brightness being less than the predetermined brightness, adjust the brightness of the display screen based on the ambient brightness and the first gray level in a case that the first gray level is less than or equal to the predetermined gray level and the first contrast is within the contrast range, wherein a maximum contrast of the contrast range is less than the predetermined contrast.

In some examples, the adjusting module 43 is configured to determine that the brightness of the display screen is positively correlated with the ambient brightness and positively correlated with the first gray level.

In some examples, the adjusting module 43 is configured to, in response to the ambient brightness being less than the predetermined brightness, adjust the brightness of the display screen based on the ambient brightness, the first contrast and the first gray level in a case that the first gray level is less than or equal to a predetermined gray level and the first contrast is greater than a predetermined contrast.

In some examples, the adjusting module 43 is configured to determine that the brightness of the display screen is positively correlated with the ambient brightness, positively correlated with the first gray level and inversely correlated with the first contrast.

In some examples, the first obtaining module 41 is configured to determine the subject object of the image based on a deep learning model and the image information.

In some examples, the second obtaining module 42 is configured to, in a case that the image comprises at least two subject objects, obtain the first contrast of the subject objects of the image based on a contrast of each subject object and a weight coefficient corresponding to each subject object.

As for the apparatus in the above examples, the specific implementation of operation of each module has been described in detail in the method examples, which will not be elaborated here.

Examples of the disclosure also provide an electronic device including:

a processor; and a memory configured to store instructions executable by the processor;

wherein the at least one processor is configured to implement the method for processing a brightness of a display screen described by any example of the disclosure when running the executable instructions.

The memory may include various types of storage medium, which is a non-temporary computer storage medium capable of continuing to remember and store information on a communication device after power failure.

The processor may be connected to the memory by bus, etc., and configured for reading executable programs stored on the memory, for example, implementing at least one of the methods shown in FIG. 1, 5 or 6.

Examples of the disclosure also provide a computer readable storage medium which stores an executable program. When the executable program is executed by a processor, the method for processing a brightness of the display screen described in any example of the disclosure is implemented. For example, at least one of the methods shown in FIG. 1, 5, or 6 is implemented.

As for the device in the above examples, the specific implementation of operation of each module has been described in detail in the method examples, which is not elaborated here.

Figure 8:
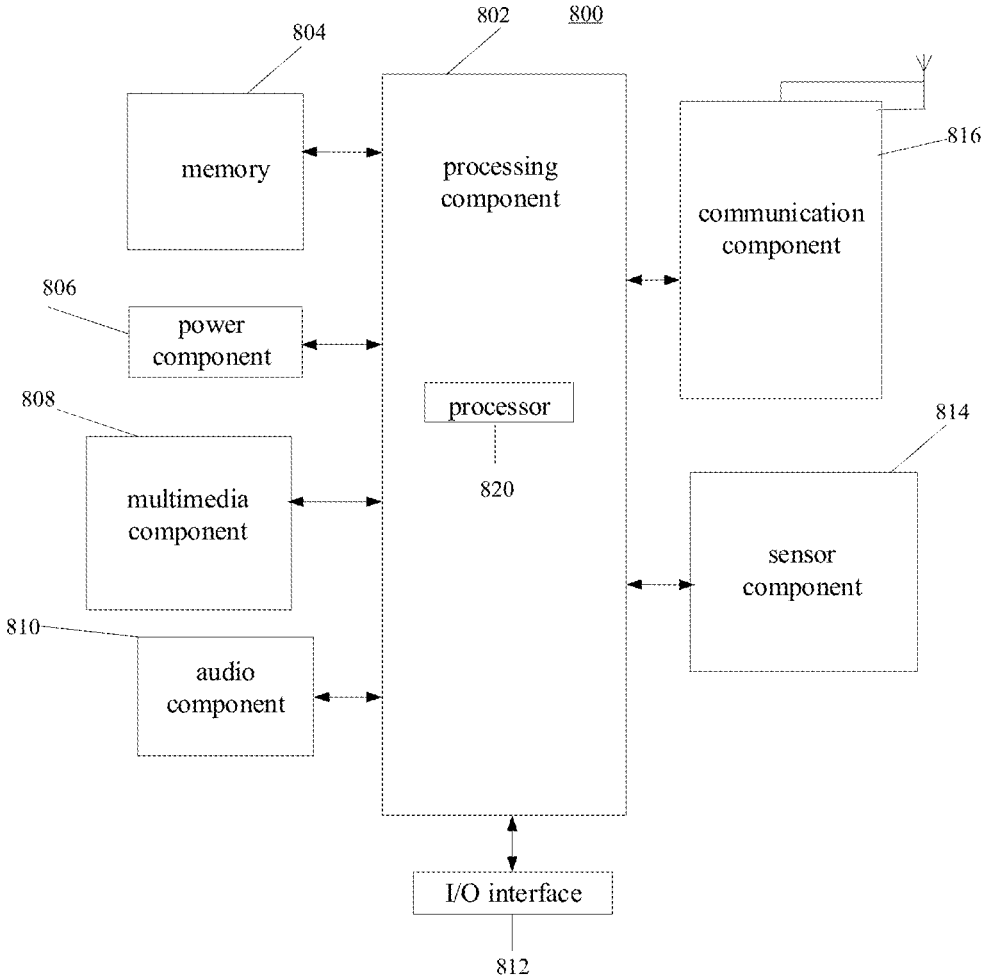
FIG. 8 is a block diagram of an electronic device according to an example.

FIG. 8 is a block diagram of an electronic device 800 according to an exemplary example. For example, the electronic device 800 may be a mobile phone, a computer, a digital broadcast terminal, a messaging device, a gaming console, a tablet, a medical device, exercise equipment, a personal digital assistant, and the like.

Referring to FIG. 8, the electronic device 800 may include one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the electronic device 800, such as the operations associated with display, telephone calls, data communications, camera operations, and recording operations. The processing component 802 may include one or more processors 820 to execute instructions to perform all or part of the steps in the above described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the electronic device 800. Examples of such data include instructions for any applications or methods operated on the electronic device 800, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the electronic device 800. The power component 806 may include a power management system, one or more power sources, and any other components associated with the generation, management, and distribution of power in the electronic device 800.

The multimedia component 808 includes a screen providing an output interface between the electronic device 800 and the user. In some examples, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some examples, the multimedia component 808 includes a front camera and/or a rear camera. The front camera and the rear camera may receive an external multimedia datum while the electronic device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone ("MIC") configured to receive an external audio signal when the electronic device 800 is in an operation mode, such as a call mode, a recording mode, and a voice recognition mode. The received audio signal may be further stored in the memory 804 or transmitted via the communication component 816. In some examples, the audio component 810 further includes a speaker to output audio signals.

The I/O interface 812 provides an interface between the processing component 802 and peripheral interface modules, such as a keyboard, a click wheel, buttons, and the like.

The buttons may include, but are not limited to, a home button, a volume button, a starting button, and a locking button.

The sensor component 814 includes one or more sensors to provide status assessments of various aspects of the electronic device 800. For instance, the sensor component 814 may detect an open/closed status of the electronic device 800, relative positioning of components, e.g., the display and the keypad, of the electronic device 800, a change in position of the electronic device 800 or a component of the electronic device 800, a presence or absence of user contact with the electronic device 800, an orientation or an acceleration/deceleration of the electronic device 800, and a change in temperature of the electronic device 800. The sensor component 814 may include a proximity sensor configured to detect the presence of nearby objects without any physical contact. The sensor component 814 may also include a light sensor, such as a CMOS or CCD image sensor, for use in imaging applications. In some examples, the sensor component 814 may also include an accelerometer sensor, a gyroscope sensor, a magnetic sensor, a pressure sensor, or a temperature sensor.

The communication component 816 is configured to facilitate communication, wired or wirelessly, between the electronic device 800 and other devices. The electronic device 800 can access a wireless network based on a communication standard, such as WiFi, 2G, or 3G, or a combination thereof. In one exemplary example, the communication component 816 receives a broadcast signal or broadcast associated information from an external broadcast management system via a broadcast channel. In one exemplary example, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary examples, the electronic device 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary examples, there is also provided a non-transitory computer-readable storage medium including instructions, such as included in the memory 804, executable by the processor 820 in the electronic device 800, for performing the above-described methods. For example, the non-transitory computer-readable storage medium may be a ROM, a RAM, a CD-ROM, a magnetic tape, a floppy disc, an optical data storage device, and the like.

Other examples of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method for processing a brightness of a display screen, comprising:

obtaining a subject object of an image based on image information of the image;

obtaining a first contrast of the subject object and a first gray level of the image;

adjusting a brightness of the display screen displaying the image based on the first contrast and the first gray level; and in response to an ambient brightness being less than a predetermined brightness, the first gray level being greater than a predetermined gray level and the first contrast being greater than a predetermined contrast, maintaining the brightness of the display screen unchanged.

2. The method of claim 1, wherein adjusting the brightness of the display screen displaying the image based on the first contrast and the first gray level comprises:

in response to the ambient brightness being less than the predetermined brightness, adjusting the brightness of the display screen displaying the image based on the ambient brightness, the first contrast and the first gray level.

3. The method of claim 2, wherein in response to the ambient brightness being less than the predetermined brightness, adjusting the brightness of the display screen displaying the image based on the ambient brightness, the first contrast and the first gray level, comprises one of:

in response to the ambient brightness being less than the predetermined brightness, the first gray level being greater than a predetermined gray level and the first contrast being within a predetermined contrast range, adjusting the brightness of the display screen based on the ambient brightness and the first gray level; and in response to the ambient brightness being less than the predetermined brightness, the first gray level being less than or equal to the predetermined gray level and the first contrast being within the predetermined contrast range, adjusting the brightness of the display screen based on the ambient brightness and the first gray level, wherein a maximum contrast of the predetermined contrast range is less than the predetermined contrast.

4. The method of claim 3, wherein adjusting the brightness of the display screen based on the ambient brightness and the first gray level comprises:

determining that the brightness of the display screen is positively correlated with the ambient brightness and positively correlated with the first gray level.

5. The method of claim 2, wherein in response to the ambient brightness being less than the predetermined brightness, adjusting the brightness of the display screen displaying the image based on the ambient brightness, the first contrast and the first gray level, comprises:

in response to the ambient brightness being less than the predetermined brightness, the first gray level being less than or equal to a predetermined gray level and the first contrast is greater than a predetermined contrast, adjusting the brightness of the display screen based on the ambient brightness, the first contrast and the first gray level.

6. The method of claim 5, wherein adjusting the brightness of the display screen based on the ambient brightness, the first contrast and the first gray level comprises:

determining that the brightness of the display screen is positively correlated with the ambient brightness, positively correlated with the first gray level and inversely correlated with the first contrast.

7. The method of claim 1, wherein when the image comprises at least two subject objects, obtaining the first contrast of the subject object comprises:

obtaining the first contrast of the subject objects of the image based on a contrast of each subject object and a weight coefficient corresponding to each subject object.

8. The method of claim 7, wherein the obtaining the first contrast of the subject objects of the image based on the contrast of each subject object and the weight coefficient corresponding to each subject object comprises:

obtaining a first value based on a product of the contrast of the subject object and the corresponding weight coefficient of the subject object; and obtaining the first contrast of the subject objects of the image based on a sum of the first values of respective subject objects.

9. The method of claim 8, wherein the weight coefficient corresponding to each subject object is determined based on at least one of an importance degree of different types of subject objects, an area of the subject object in the image, and a position of the subject object in the image.

10. An electronic device, comprising:

at least one processor; and a memory configured to store instructions executable by the at least one processor;

wherein the at least one processor is configured to run the executable instructions, so as to perform operations of:

obtaining a subject object of an image based on image information of the image;

obtaining a first contrast of the subject object and a first gray level of the image;

adjusting a brightness of a display screen displaying the image based on the first contrast and the first gray level; and in response to an ambient brightness being less than a predetermined brightness, the first gray level being greater than a predetermined gray level and the first contrast being greater than a predetermined contrast, maintaining the brightness of the display screen unchanged.

11. The electronic device of claim 10, wherein the at least one processor is configured to perform operations of:

in response to the ambient brightness being less than the predetermined brightness, adjusting the brightness of the display screen displaying the image based on the ambient brightness, the first contrast and the first gray level.

12. The electronic device of claim 11, wherein the at least one processor is configured to perform operations of:

in response to the ambient brightness being less than the predetermined brightness, the first gray level being greater than a predetermined gray level and the first contrast being within a predetermined contrast range, adjusting the brightness of the display screen based on the ambient brightness and the first gray level; or in response to the ambient brightness being less than the predetermined brightness, the first gray level being less than or equal to the predetermined gray level and the first contrast being within the predetermined contrast range, adjusting the brightness of the display screen based on the ambient brightness and the first gray level, wherein a maximum contrast of the predetermined contrast range is less than the predetermined contrast.

13. The electronic device of claim 12, wherein the at least one processor is configured to perform operations of:

determining that the brightness of the display screen is positively correlated with the ambient brightness and positively correlated with the first gray level.

14. The electronic device of claim 11, wherein the at least one processor is configured to perform operations of:

in response to the ambient brightness being less than the predetermined brightness, the first gray level being less than or equal to a predetermined gray level and the first contrast is greater than a predetermined contrast, adjusting the brightness of the display screen based on the ambient brightness, the first contrast and the first gray level.

15. The electronic device of claim 14, wherein the at least one processor is configured to perform operations of:

determining that the brightness of the display screen is positively correlated with the ambient brightness, positively correlated with the first gray level and inversely correlated with the first contrast.

16. The electronic device of claim 10, wherein when the image comprises at least two subject objects, the at least one processor is configured to perform operations of:

obtaining the first contrast of the subject objects of the image based on a contrast of each subject object and a weight coefficient corresponding to each subject object.

17. A non-transitory computer readable storage medium configured to store executable programs thereon, when executed by at least one processor, implement acts comprising:

obtaining a subject object of an image based on image information of the image;

obtaining a first contrast of the subject object and a first gray level of the image;

adjusting a brightness of a display screen displaying the image based on the first contrast and the first gray level; and in response to an ambient brightness being less than a predetermined brightness, the first gray level being greater than a predetermined gray level and the first contrast being greater than a predetermined contrast, maintaining the brightness of the display screen unchanged.

18. The non-transitory computer readable storage medium of claim 17, wherein the acts further comprise:

in response to the ambient brightness being less than the predetermined brightness, adjusting the brightness of the display screen displaying the image based on the ambient brightness, the first contrast and the first gray level.

19. The non-transitory computer readable storage medium of claim 18, wherein the acts further comprise:

in response to the ambient brightness being less than the predetermined brightness, the first gray level being greater than a predetermined gray level and the first contrast being within a predetermined contrast range, adjusting the brightness of the display screen based on the ambient brightness and the first gray level; or in response to the ambient brightness being less than the predetermined brightness, the first gray level being less than or equal to the predetermined gray level and the first contrast being within the predetermined contrast range, adjusting the brightness of the display screen based on the ambient brightness and the first gray level, wherein a maximum contrast of the predetermined contrast range is less than the predetermined contrast.

* * * * *